US005732856A

United States Patent [19]

Fry

[11] Patent Number: 5,732,856

[45] Date of Patent: Mar. 31, 1998

[54] BEVERAGE CONVEYANCE SYSTEM BETWEEN BEVERAGE STORAGE AND DISPENSING

[76] Inventor: David A. Fry, 15359 SE. Duckey La., Milwaukie, Oreg. 97267

[21] Appl. No.: 589,656

[22] Filed: Jan. 22, 1996

[51] Int. Cl.[6] ..... B67D 5/62

[52] U.S. Cl. ..... 222/146.6

[58] Field of Search ..... 222/146.6, 394, 222/399; 62/390, 393, 396

[56] References Cited

U.S. PATENT DOCUMENTS

| | | | |
|---|---|---|---|
| 4,094,445 | 6/1978 | Bevan | 222/146.6 X |
| 4,730,463 | 3/1988 | Stanfill | 222/146.6 X |
| 4,949,552 | 8/1990 | Adams . | |
| 5,009,082 | 4/1991 | Abraham, III | 62/393 X |
| 5,564,602 | 10/1996 | Cleland et al. | 62/396 X |

OTHER PUBLICATIONS

"Air Control for Hydronic Systems" Bell & Gossett –ITT –1966.

*Primary Examiner*—Gregory L. Huson
*Attorney, Agent, or Firm*—Robert L. Harrington

[57] ABSTRACT

A closed, low volume, pressurized cooling system for cooling beverages transported through conveying lines from a beverage source to a dispensing station. The pressurized, low gallonage coolant system has its coolant (water/glycol) cooled by a refrigeration system. The coolant is recirculated on a continuous basis and has a cooling line in contact with the beverage conveying lines to chill the beverages contained in the beverage conveying lines. A thermostat monitors the temperature of the coolant and the refrigeration unit runs only on demand. The coolant in the cooling system is pressurized by a bladder type pressure tank. The closed, pressurized coolant system minimizes separation and evaporization of the coolant and prevents contamination of the coolant.

3 Claims, 1 Drawing Sheet

BEVERAGE CONVEYANCE SYSTEM BETWEEN BEVERAGE STORAGE AND DISPENSING

FIELD OF THE INVENTION

This invention relates to a cooling system for a beverage dispensing unit wherein the beverage, e.g., beer, is dispensed at a point remote from where the beverage is stored.

BACKGROUND OF THE INVENTION

Beverages such as beer are often provided to various establishments in huge containers, e.g., kegs, that are stored in a cooler necessarily located a substantial distance from where the beverage is to be dispensed, e.g., a beer keg is stored in a basement cooler and dispensed to customers in an upstairs lounge area. A line extends between the keg and the dispensing tap. Even though the cooler maintains the beer in the keg at a desired temperature, by the time it travels through the line it is undesirably warmed. Obviously the beverage is not dispensed continuously and the intervals between the dispensing results in further warming.

The problem has been largely resolved by providing an encapsulated jacket around the beer conveying lines and running a second line inside the jacket and along side the beer conveying line that continuously circulates a cooling liquid, e.g., glycol. The glycol is circulated at a consistent rate an at a constant temperature to prevent the line (and the beverage in the line) from significantly rising in temperature.

A problem with the system as originally designed is that the glycol was stored in an open vat (to prevent air locks) with cooling coils provided in the vat for cooling the glycol. The glycol would often separate with a water component evaporating from the glycol; the glycol would become contaminated and create problems in the system; and, the open vat would rapidly warm requiring excessive energy for cooling.

The above problems are largely resolved by a system described in U.S. Pat. No. 4,949,552. The glycol is contained in a closed system including a partially filled but closed supply tank containing glycol. The glycol is pumped from the bottom of the tank and then circulated through a cooling coil before joining the beer line en route to the dispensing tap. The glycol is rotated back to the top of the supply tank where any air in the glycol separates from the glycol. The temperature of the glycol is controlled by gauging the vapor pressure in the cooling coil. When the correct temperature is attained, the condenser coil is bypassed and then opened when additional cooling is required.

BRIEF SUMMARY OF THE INVENTION

The system of the '552 patent is further improved with the present invention. The present invention is also a closed system but adds a pressurization tank that places the glycol in the line under pressure. The pressurized glycol provides improved control over temperature, faster temperature response and quieter system operation. Piping and operating costs are reduced substantially.

In the preferred embodiment, a bladder enclosed in a pressurization tank is utilized. With the bladder containing glycol and under pressure, any drop in the glycol within the line, e.g., through leakage or temperature difference, is accommodated by replacement glycol from the bladder. A bleed valve removes all air from the system and temperature of the glycol and thus the beverage is controlled by a sensor that controls the cooling process.

In general, the system comprises three interconnected systems. A cooling system is designed to provide a cooling coil that is enclosed in an insulated jacket also containing a section or coil of the glycol transmitting line. The glycol is cooled by the cooling coil. The glycol transmitting system includes a conveying or transmitting line that conveys the glycol from the cooling coil to an enclosed supply tank. The cooled glycol from the supply tank is drawn by a pump past a pressurization station (the mentioned bladder enclosed tank) and then along a path between a beer source and a beer dispenser. A beverage conveyance system includes a container of beverage, a line that extends from the container along the path of the glycol and surrounded by an insulated jacket whereby it is cooled by the glycol. It is connected to the dispensing tap where it is available, in a cooled state, on demand. The glycol is cycled back to the cooling coil and is continuously pumped through the system. Both the cooling system and beverage conveyance system are operated intermittently, the cooling system operative on demand as the beverage causes reduction in the glycol temperature.

The invention and its several advantages over the prior system will become more apparent upon reference to the following detailed description and drawings referred to therein.

DESCRIPTION OF THE PREFERRED EMBODIMENT

Figures 1, 2, 3:
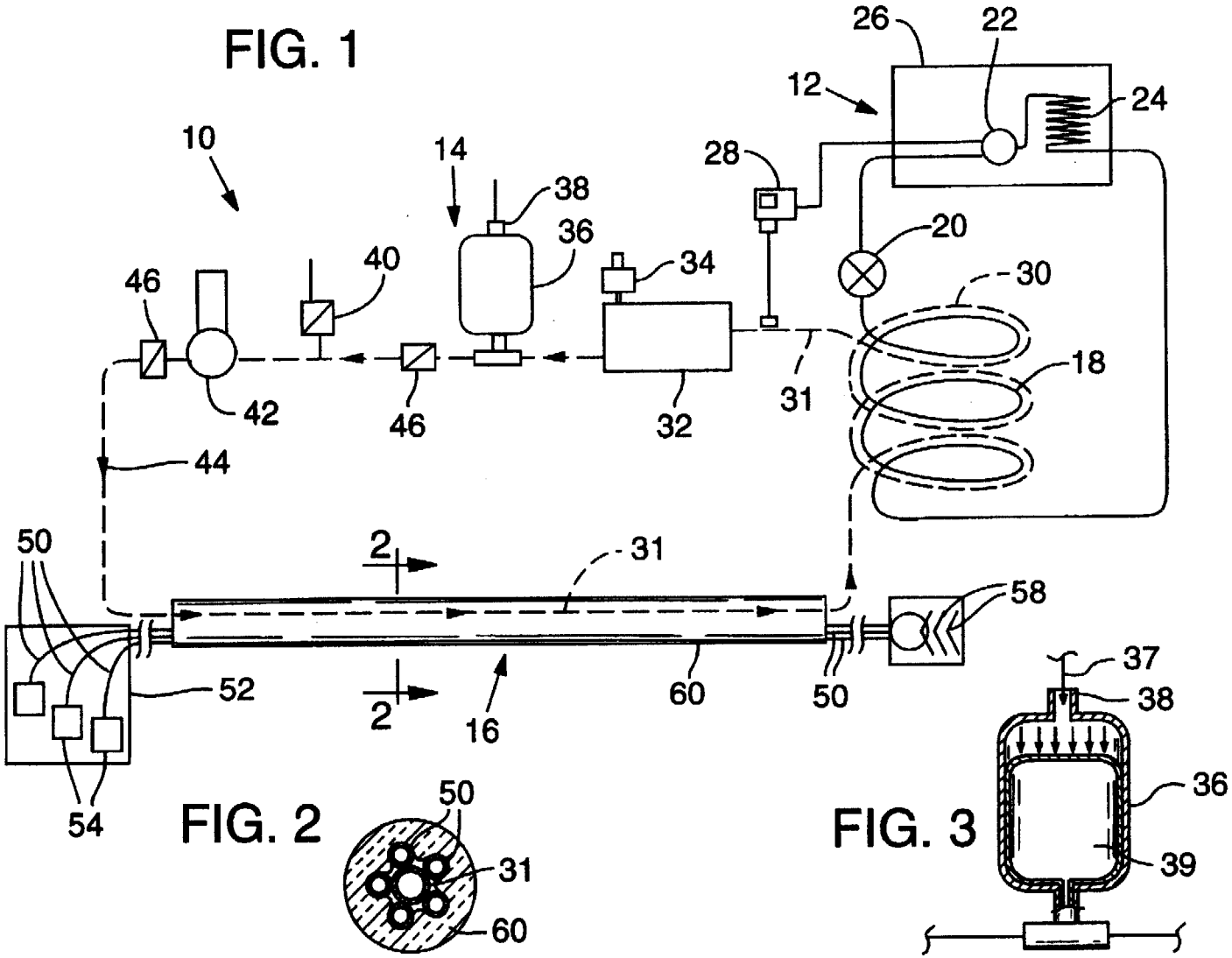
FIG. 1 is a schematic illustration of a pressurized beverage cooling system.
FIG. 2 is a view as viewed along view lines 2—2 of FIG. 1 illustrating a beverage line set including a coolant line of the present invention.
FIG. 3 is a section view of the pressurization tank used in the system.

Refer now to FIG. 1 of the drawings which schematically illustrates a pressurized beverage cooling system 10 of the present invention. The cooling system 10 comprises in combination three separate systems and includes a sealed refrigeration system 12, a sealed and pressurized water/glycol cooling system 14 and a beverage conveying system 16.

The sealed refrigeration unit 12 is of conventional design that incorporates a coaxial evaporator 18 that is utilized to cool the water/glycol coolant that is utilized in the cooling system 14. The refrigeration system 12 includes an expansion valve 20 and has a compressor 22 and a condenser 24 housed within a cabinet indicated by 26. The coaxial evaporator 18 has coils 30 of the coolant system 14 running within the coaxial evaporator 18 in a conventional manner. The refrigeration unit 12 is controlled by a thermostat 28 that monitors the temperature of the water/glycol coolant in the cooling system 14.

The cooling system 14 is a closed system and has a line 31 for re-circulating the water/glycol coolant throughout the system 14. The line 31 extends from the coils 30 and inter-connects a reservoir 32, a pressure tank 36 and a pump 42. The reservoir 32 is sized to contain a small volume of water/glycol coolant. The reservoir 32 has an air purging valve 34 that is utilized to eliminate air in the system 14. The air purging valve 34 will exhaust any air that is contained in the reservoir 32 and further will exhaust any air that emanates from the water/glycol coolant. A conventional bladder-type pressure tank 36 (see FIG. 3) is utilized to maintain pressure on the water/glycol coolant in the system 14. The pressure tank 36 includes an air inlet port 38 which is provided to facilitate injecting air (arrow 37) on top of a bladder 39 to thus provide pressure on the water/glycol coolant. A fill valve 40 which communicates with the line 31 of the glycol coolant system 14 is provided for filling the system 14 with the glycol/water coolant and for adding water/glycol coolant to the system as required. The water/glycol coolant is circulated throughout the cooling system 14 by a pump 42. The circulating lines 31 extend from the pump 42 to a beverage conveying system 16. As seen in FIG. 2, the line 31 is in intimate contact with the beverage conveying lines 50 of the beverage conveying system 16. Conventional shut off valves 46 are provided in the line 31.

The beverage conveying system 16 includes a beverage source indicated by 52 and in this embodiment, the beverage source 52 includes multiple kegs of beer 54. The kegs 54 are connected to a dispensing station by individual lines 50. The beverage (beer) is conveyed from the source 52 to the dispensing taps 58 of the dispensing station by the lines 50 in a conventional manner. The beverage conveyor lines 50 surround the water/glycol coolant line 31 as indicated in FIG. 2. The cooled water/glycol coolant will thus maintain and/or lower the temperature of the beer in the lines 50 as it is conveyed from the beverage source 52 to the dispensing station.

FIG. 2 illustrates the line 31 surrounded by the beverage lines 50. In the illustration the line 31 is surrounded by five lines 50. The number of lines 50 may be varied to suit the requirements. The bundle of the line 31 and the beverage lines 50 are insulated in a conventional manner by known insulating material, the insulating material being indicated by numeral 60.

The absorption of the heat by the glycol coolant system 14 is essentially prevented by suitably insulating the coolant line 31, the reservoir 32, the pressure tank 36 and the fill and shut off valves. It will be appreciated that the line 31 will not be insulated where it is in contact with the beverage dispensing lines 50. The beverage dispensing lines 50 and the coolant line 31 are intended to transfer heat from the beverage dispensing lines 50 to the coolant line 31 and, therefore, line 31 is not insulated where it runs in close proximity to the beverage dispensing lines 50. As previously mentioned, the bundle of the beverage dispensing lines 50 and the coolant line 31 are, however, suitably insulated to prevent heat absorption from external sources.

The glycol cooling system 14 is a pressurized system which greatly aids in reducing separation of the water/glycol mixture and further reduces the effect of evaporation. Another advantage of the closed pressurized cooling system 14 is that the water/glycol mixture is not subject to contamination. The water/glycol cooling system 14 is a low volume system requiring very low gallonage of coolant. Thus, the refrigeration unit 12 need only cool a small volume of the water/glycol coolant that is utilized to cool the beverage in the lines 50.

The pump 42 circulates the water/glycol coolant on a continuous basis through the coolant system 14. The pump 42 will pump the glycol/water coolant through the line 31 as indicated by arrows 44 and as shown the coolant will flow through the line 31 and as it flows through line 31 adjacent the beverage lines 50 the beverages in the lines 50 will be cooled by the chilled water/glycol coolant of the coolant system 14. As the coolant exits the area of the beverage lines 50, the coolant will be circulated through the coils 30 of the coaxial evaporator 18 and will be chilled according to the demand presented by the thermostat 28. Refrigeration unit 12 will only run on demand for cooling.

Those skilled in the art will recognize that modifications and variations may be made without departing from the true spirit and scope of the invention. The invention is therefore not to be limited to the embodiments described and illustrated but is to be determined from the appended claims.

I claim:

1. A beverage cooling system comprising:

a plurality of sub-systems including a cooling system, a cooling liquid conveying system and a beverage conveying system;

said cooling system including a cooling station and a cooling coil, said cooling station transmitting a coolant through the cooling coil;

said cooling liquid conveying system including a conveying line having a first section of the line provided in close adjacency with said cooling coil, a cooling liquid in the conveying line and conveyed through the first section to be cooled by the coolant conveyed through the cooling coil, said conveying line being a closed line, and a pressurization member connected to the closed line providing a positive pressure to the cooling liquid in the closed line, a second section of the conveying line extending between a beverage source and a beverage dispensing station and continuing back to the first section, and a pump connected to the closed line independent of the pressurization member for pumping the pressurized cooling liquid through the closed pressurized line; and said beverage conveying system including a beverage conveying line extending from the beverage source to the beverage dispensing station and adjoining said second section of the cooling liquid conveying line for cooling the beverage in the beverage conveying line.

2. A beverage conveying system as defined in claim 1 wherein the cooling liquid is glycol and the pressurization member is a bladder enclosed container including a pressurization valve for applying external pressure on the bladder containing glycol and connected to the glycol conveying line.

3. A beverage conveying system as defined in claim 2 including a sensor sensing the temperature of the glycol from the first section, and a control controlling the cooling station and responsive to the sensor for controlling the temperature of the glycol.

* * * * *